US010902786B2

(12) United States Patent
Park et al.

(10) Patent No.: US 10,902,786 B2
(45) Date of Patent: Jan. 26, 2021

(54) DISPLAY DEVICE AND DRIVING METHOD THEREOF

(71) Applicant: Samsung Display Co., Ltd., Yongin-si (KR)

(72) Inventors: Jong Won Park, Yongin-si (KR); Seung Kyu Lee, Yongin-si (KR); Hyun Woong Kim, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 65 days.

(21) Appl. No.: 16/121,423

(22) Filed: Sep. 4, 2018

(65) Prior Publication Data

US 2019/0096332 A1 Mar. 28, 2019

(30) Foreign Application Priority Data

Sep. 22, 2017 (KR) ..... 10-2017-0122524

(51) Int. Cl.
*G09G 3/3266* (2016.01)
*G09G 3/3283* (2016.01)
(Continued)

(52) U.S. Cl.
CPC ..... *G09G 3/3266* (2013.01); *G09G 3/3225* (2013.01); *G09G 3/3233* (2013.01);
(Continued)

(58) Field of Classification Search
CPC ..... G09G 3/3225; G09G 3/3233; G09G 2320/0209; G09G 3/3266; G09G 2310/0262; G09G 2310/0251; G09G 2300/0819; G09G 2310/08; G09G 3/3208; G09G 2300/0861; G09G 3/3283; G09G 2320/0214; G09G 2310/06
See application file for complete search history.

(56) References Cited

U.S. PATENT DOCUMENTS 9,276,050 B2 3/2016 Kwon et al.
9,634,038 B2 4/2017 Kwon et al.
(Continued)

FOREIGN PATENT DOCUMENTS

JP 2003-330412 A 11/2003
KR 10-1687069 B1 12/2016
(Continued)

OTHER PUBLICATIONS

Extended European Search Report dated Dec. 21, 2018 for corresponding European Application No. 18195804.2, 10 pages.

*Primary Examiner* — Muhammad N Edun
(74) *Attorney, Agent, or Firm* — Lewis Roca Rothgerber Christie LLP

(57) ABSTRACT

The display device includes a pixel circuit including a driving transistor, an N-type transistor on a first path coupled from a data line to a gate electrode of the driving transistor, and a P-type transistor on the first path, a first scan driver to supply a first scan signal to the N-type transistor, and a second scan driver to supply a second scan signal to the P-type transistor, wherein a width of a high level section of the first scan signal is wider than that of a low level section of the second scan signal, and the low level section of the second scan signal overlaps with the high level section of the first scan signal.

16 Claims, 12 Drawing Sheets

(51) Int. Cl.
*G09G 3/3233* (2016.01)
*G09G 3/3225* (2016.01)

(52) U.S. Cl.
CPC ... *G09G 3/3283* (2013.01); *G09G 2300/0819* (2013.01); *G09G 2300/0861* (2013.01); *G09G 2310/0251* (2013.01); *G09G 2310/0262* (2013.01); *G09G 2310/06* (2013.01); *G09G 2310/08* (2013.01); *G09G 2320/0209* (2013.01); *G09G 2320/0214* (2013.01)

(56) References Cited

U.S. PATENT DOCUMENTS

| | | | | |
|---|---|---|---|---|
| 9,705,008 | B2 | 7/2017 | Li | |
| 2006/0267049 | A1* | 11/2006 | Tang | G09G 3/3233 257/225 |
| 2007/0018078 | A1* | 1/2007 | Miyazawa | H03F 3/08 250/214.1 |
| 2009/0027312 | A1* | 1/2009 | Han | G09G 3/3233 345/76 |
| 2011/0273408 | A1* | 11/2011 | Ra | G09G 3/3266 345/204 |
| 2015/0243715 | A1* | 8/2015 | Shin | H01L 27/3276 257/40 |
| 2016/0284276 | A1* | 9/2016 | Gupta | G09G 3/3225 |
| 2016/0322446 | A1 | 11/2016 | Park et al. | |
| 2018/0006099 | A1 | 1/2018 | Ka et al. | |

FOREIGN PATENT DOCUMENTS

| | | | |
|---|---|---|---|
| KR | 10-2017-0028986 | A | 3/2017 |
| KR | 10-2018-0004369 | A | 1/2018 |

* cited by examiner

DISPLAY DEVICE AND DRIVING METHOD THEREOF

CROSS-REFERENCE TO RELATED APPLICATION

This application claims priority to, and the benefit of, Korean Patent Application No. 10-2017-0122524, filed on Sep. 22, 2017, in the Korean Intellectual Property Office, the entire disclosure of which is incorporated by reference herein.

BACKGROUND

1. Field

An aspect of the present disclosure relates to a display device and to a driving method thereof.

2. Description of the Related Art

With the development of information technologies, the importance of a display device, which is a connection medium between a user and information, increases. Accordingly, display devices, such as a liquid crystal display device, an organic light emitting display device, and a plasma display panel, are increasingly used.

Among these display devices, the organic light emitting display device displays images using an organic light emitting diode that generates light by recombination of electrons and holes. The organic light emitting display device has a high response speed, and is driven with low power consumption.

The organic light emitting display device displays a target image to a user by writing a respective data voltage for expressing a respective target gray scale in each pixel, and allowing the organic light emitting diode to emit light corresponding to the data voltage.

However, in typical organic light emitting display devices, a parasitic capacitance between a transistor of a pixel circuit and a gate line occurs according to data voltages. Hence, if a high data voltage is applied to a specific pixel circuit, the phase of a scan signal of a gate line corresponding to the specific pixel circuit may be varied.

The scan signal having the varied phase varies a compensation time of an adjacent pixel circuit, and therefore a horizontal crosstalk occurs in which a gray scale that is different from the target gray scale is expressed, as the data voltage is not sufficiently written in the adjacent pixel circuit.

SUMMARY

Embodiments provide a display device and a driving method thereof, which can ensure a sufficient compensation time, thereby being robust against horizontal crosstalk.

According to an aspect of the present disclosure, there is provided a display device including a pixel circuit including a driving transistor, an N-type transistor located on a first path coupled from a data line to a gate electrode of the driving transistor, and a P-type transistor located on the first path, a first scan driver configured to supply a first scan signal to the N-type transistor, and a second scan driver configured to supply a second scan signal to the P-type transistor, wherein a width of a high level section of the first scan signal is wider than that of a low level section of the second scan signal, and the low level section of the second scan signal overlaps with the high level section of the first scan signal.

A rising transition time of the first scan signal may correspond to a falling transition time of the second scan signal.

A falling transition time of the first scan signal may be after a rising transition time of the second scan signal.

The P-type transistor may be coupled between the data line and one end of the driving transistor, and the N-type transistor may be coupled between the other end of the driving transistor and the gate electrode of the driving transistor.

The display device may further include a timing controller configured to supply a first driving clock signal and a second driving clock signal to the first scan driver and the second scan driver, respectively, wherein the first scan driver supplies a portion of the first driving clock signal as the first scan signal, and the second scan driver supplies a portion of the second driving clock signal as the second scan signal.

The timing controller may further supply a first control clock signal to the first scan driver, and a period of the first control clock signal may determine an allowable range of the width of a high level section of the portion of the first driving clock signal.

A falling transition time of the first control clock signal may be a maximum value of the allowable range.

The timing controller may supply the first driving clock signal having the width of a high level section, which is independently determined for each frame.

The timing controller may determine the width of a high level section of the first driving clock signal according to a maximum data voltage applied to the data line during one frame.

The timing controller may increase the width of the high level section of the first driving clock signal as the maximum data voltage become higher.

According to an aspect of the present disclosure, there is provided a method for driving a display device including a driving transistor, an N-type transistor located on a first path coupled from a data line to a gate electrode of the driving transistor, and a P-type transistor located on the first path, the method including applying a specific voltage to the data line, applying a first scan signal having a high level to a gate electrode of the N-type transistor, and applying a second scan signal having a low level to a gate electrode of the P-type transistor, wherein a width of a high level section of the first scan signal is wider than that of a low level section of the second scan signal, and wherein the low level section of the second scan signal overlaps with the high level section of the first scan signal.

A rising transition time of the first scan signal may correspond to a falling transition time of the second scan signal.

A falling transition time of the first scan signal may be after a rising transition time of the second scan signal.

The method may further include independently determining the width of the high level section of the first scan signal for each frame.

The width of the high level section of the first scan signal may be determined corresponding to a maximum data voltage applied to the data line during one frame.

The width of the high level section of the first scan signal may be increased as the maximum data voltage becomes higher.

BRIEF DESCRIPTION OF THE DRAWINGS

Example embodiments will now be described more fully hereinafter with reference to the accompanying drawings.

DETAILED DESCRIPTION

Figure 1:
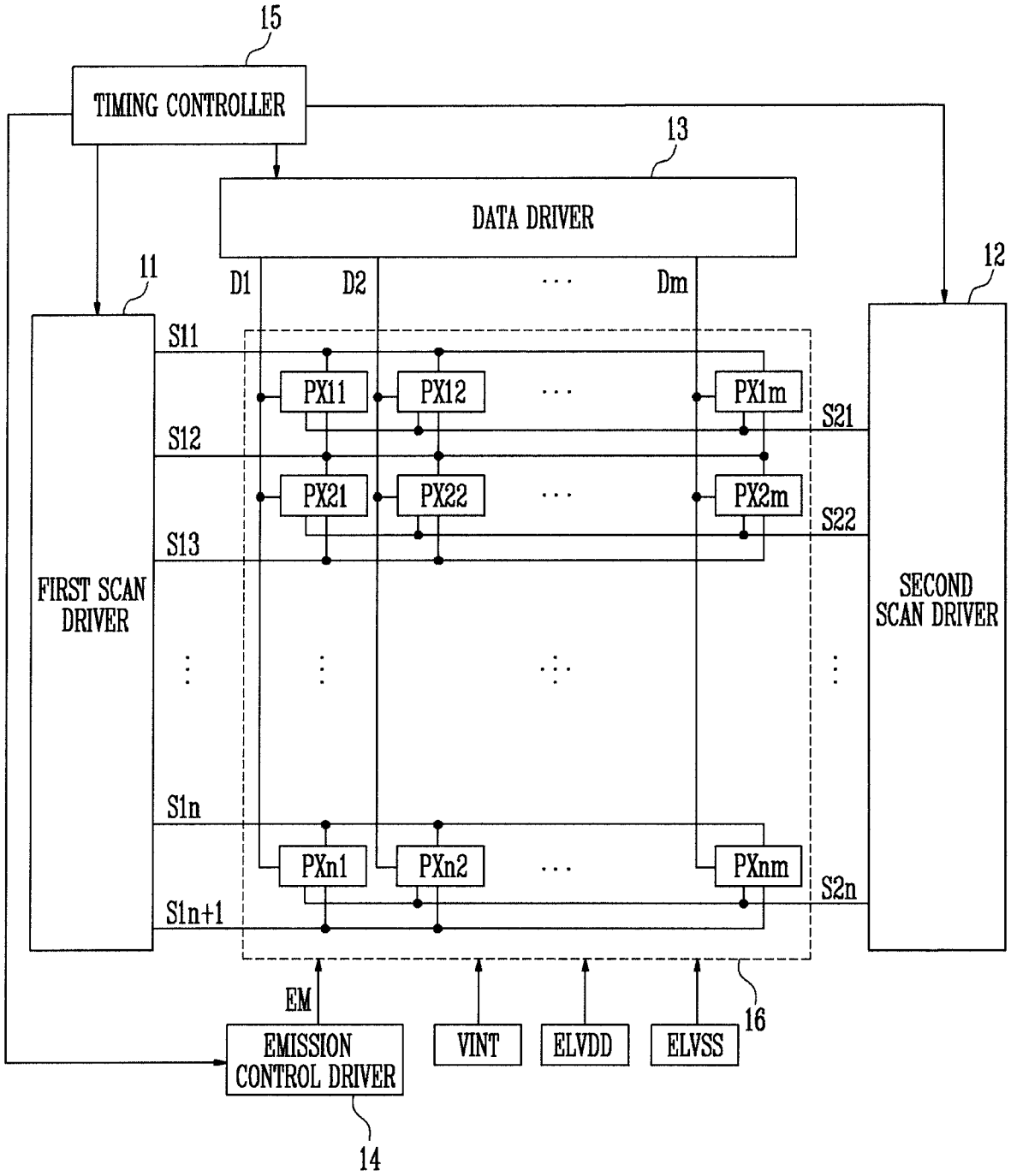
FIG. 1 is a diagram illustrating a display device according to an embodiment of the present disclosure.

Features of the inventive concept and methods of accomplishing the same may be understood more readily by reference to the following detailed description of embodiments and the accompanying drawings. Hereinafter, embodiments will be described in more detail with reference to the accompanying drawings. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. Further, parts not related to the description of the embodiments might not be shown to make the description clear. In the drawings, the relative sizes of elements, layers, and regions may be exaggerated for clarity.

In the following description, for the purposes of explanation, numerous specific details are set forth to provide a thorough understanding of various embodiments. It is apparent, however, that various embodiments may be practiced without these specific details or with one or more equivalent arrangements. In other instances, well-known structures and devices are shown in block diagram form in order to avoid unnecessarily obscuring various embodiments.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly. Similarly, when a first part is described as being arranged "on" a second part, this indicates that the first part is arranged at an upper side or a lower side of the second part without the limitation to the upper side thereof on the basis of the gravity direction.

It will be understood that when an element, layer, region, or component is referred to as being "on," "connected to," or "coupled to" another element, layer, region, or component, it can be directly on, connected to, or coupled to the other element, layer, region, or component, or one or more intervening elements, layers, regions, or components may be present. However, "directly connected/directly coupled" refers to one component directly connecting or coupling another component without an intermediate component. Meanwhile, other expressions describing relationships between components such as "between," "immediately between" or "adjacent to" and "directly adjacent to" may be construed similarly. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "comprises," "comprising," "have," "having," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

When a certain embodiment may be implemented differently, a specific process order may be performed differently from the described order. For example, two consecutively described processes may be performed substantially at the same time or performed in an order opposite to the described order.

Various embodiments are described herein with reference to sectional illustrations that are schematic illustrations of embodiments and/or intermediate structures. As such, variations from the shapes of the illustrations as a result, for example, of manufacturing techniques and/or tolerances, are to be expected. Further, specific structural or functional descriptions disclosed herein are merely illustrative for the purpose of describing embodiments according to the concept of the present disclosure. Thus, embodiments disclosed herein should not be construed as limited to the particular illustrated shapes of regions, but are to include deviations in shapes that result from, for instance, manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the drawings are schematic in nature and their shapes are not intended to illustrate the actual shape of a region of a device and are not intended to be limiting. Additionally, as those skilled in the art would realize, the described embodiments may be modified in various different ways, all without departing from the spirit or scope of the present disclosure.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a diagram illustrating a display device according to an embodiment of the present disclosure.

Referring to FIG. 1, the display device according to the present embodiment includes a display unit 16, a first scan driver 11, and a second scan driver 12. In some embodiments, the display device may further include a timing controller 15, a data driver 13, an emission control driver 14, and a plurality of power sources VINT, ELVDD, and ELVSS.

The timing controller 15 generates a data driving control signal and first and second scan driving control signals in accordance with externally supplied synchronization signals. The timing controller 15 supplies the data driving control signal to the data driver 13, and supplies the first and second scan driving control signals respectively to the first and second scan drivers 11 and 12. Also, the timing controller 15 realigns externally supplied data to be suitable for specifications of the data driver 13, and supplies the realigned data to the data driver 13.

The first scan driver 11 receives the first scan driving control signal from the timing controller 15. The first scan driver 11 supplied with the first driving control signal generates a first scan signal, and supplies the generated first scan signal to first scan lines S11, S12, S13, . . . , S1*n*, and S1*n*+1. In an embodiment, the first scan driver 11 may sequentially supply the first scan signal having a high level to the first scan lines S11, S12, S13, . . . , S1*n*, and S1*n*+1. The first scan driving control signal may include a scan start pulse SSP1, first driving clock signals CLK1 and CLK2, and control clock signals EM_CLK1 and EM_CLK2 (see FIG. 2).

The second scan driver 12 receives the second scan driving control signal from the timing controller 15. The second scan driver 12 supplied with the second scan driving control signal generates a second scan signal, and supplies the generated second scan signal to second scan lines S21, S22, S2*n*. In an embodiment, the second scan driver 12 may sequentially supply the second scan signal having a low level to the second scan lines S21, S22, S2*n*. The second scan driving control signal may include a scan start pulse SSP2 and second driving clock signals CLK3 and CLK4 (see FIG. 4).

The emission control driver 14 may supply an emission control signal EM to each pixel according to a control signal supplied from the timing controller 15. If the emission control signal EM has an ON level, a current is supplied to an organic light emitting diode of a corresponding pixel as the current is applied to an emission control transistor of the corresponding pixel. Thus, the corresponding pixel emits light. The emission control signal EM having the ON level may be equally supplied to all pixels at the same time, or may be sequentially supplied to the pixels in units of scan lines.

The data driver 13 receives the data driving control signal and data from the timing controller 15. The data driver 13 converts the data into an analog data voltage using the data driving control signal, and supplies the data voltage to data lines D1, D2, . . . Dm to be synchronized with the first and second scan signals.

The display unit 16 includes a plurality of pixel circuits PX11, PX12, . . . , PX1*m*, PX21, PX22, . . . , PX2*m*, . . . , PXn1, PXn2, . . . , PXnm. Each of the pixel circuits is coupled to a corresponding data line and to corresponding first and second scan lines. Also, each of the pixel circuits receives the plurality of power sources VINT, ELVDD, and ELVSS, and receives the emission control signal EM applied from the emission control driver 14. Each of the pixel circuits emits light with a corresponding target gray scale based on the first and second scan signals, the emission control signal, and the data voltage. The plurality of pixel circuits PX11, PX12, . . . , PX1*m*, PX21, PX22, . . . , PX2*m*, . . . , PXn1, PXn2, . . . , PXnm have the same pixel circuit structure, and therefore, the pixel circuit PX11 will be described below.

Figure 2:
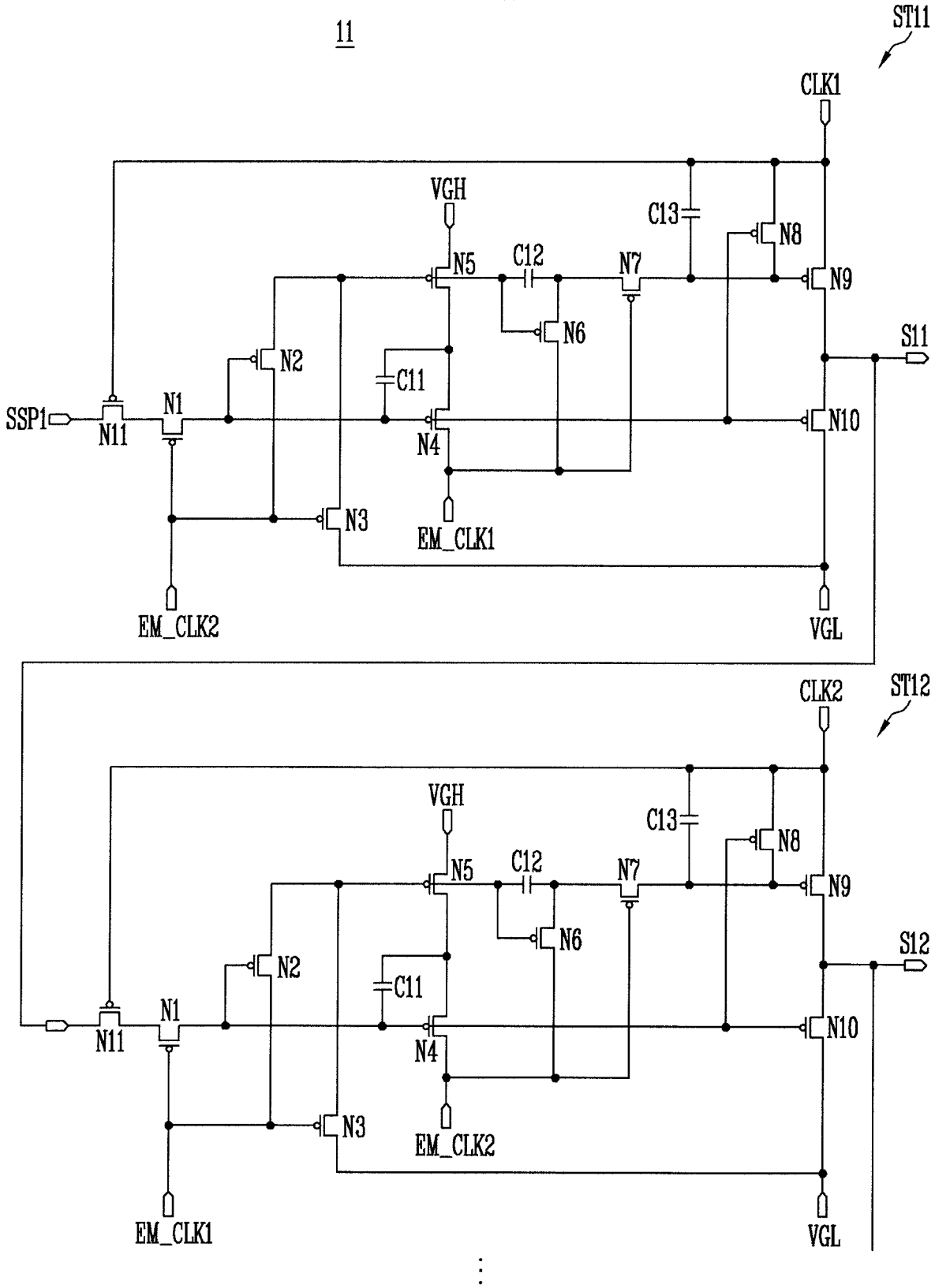
FIG. 2 is a diagram illustrating a first scan driver according to an embodiment of the present disclosure.
Figure 3:
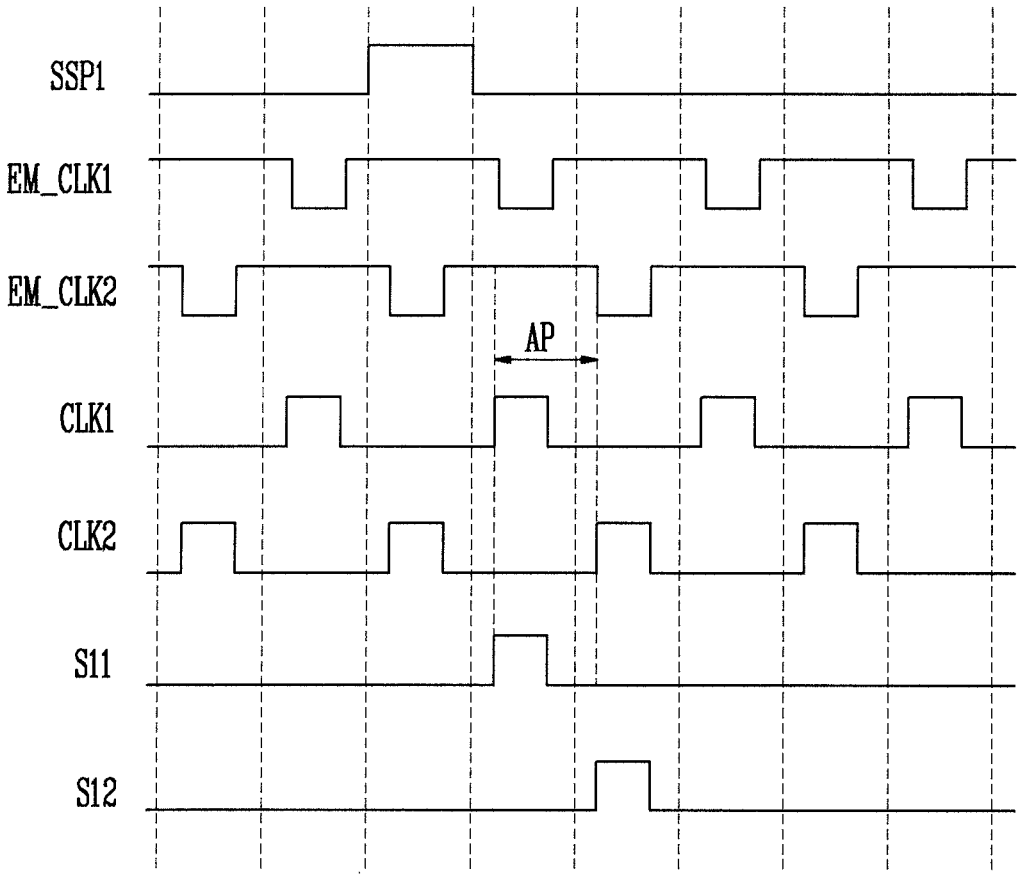
FIG. 3 is an exemplary timing diagram of the first scan driver of FIG. 2.

FIG. 2 is a diagram illustrating a first scan driver according to an embodiment of the present disclosure. FIG. 3 is an exemplary timing diagram of the first scan driver of FIG. 2. The distance between longitudinal dotted lines of FIG. 3 may correspond to one horizontal period.

Referring to FIG. 2, the first scan driver 11 according to the present embodiment includes a plurality of stages ST11, ST12, . . . . Because the stages have the same circuit configuration, the stages are described based on an initial stage ST11 in FIG. 2. The other stages ST12, . . . may be coupled in the form of shift registers from the initial stage ST11. For example, there is illustrated a form in which a second stage ST12 is coupled to the initial stage ST11.

The stage ST11 may include a plurality of transistors N1, N2, N3, N4, N5, N6, N7, N8, N9, N10, and N11 and a plurality of capacitors C11, C12, and C13. In FIG. 2, it is illustrated that the plurality of transistors N1, N2, N3, N4, N5, N6, N7, N8, N9, N10, and N11 are P-type transistors, but a circuit for performing the same function, while using N-type transistors, may be derived without undue experimentation by those skilled in the art.

A scan start pulse SSP1 is applied to one end of the transistor N11, and a first driving clock signal CLK1 is applied to a gate electrode of the transistor N11.

One end of the transistor N1 is coupled to the other end of the transistor N11, and a control clock signal EM_CLK2 is applied to a gate electrode of the transistor N1.

The control clock signal EM_CLK2 is applied to one end of the transistor N2, and a gate electrode of the transistor N2 is coupled to the other end of the transistor N1.

One end of the transistor N3 is coupled to a low voltage power source VGL, a gate electrode of the transistor N3 is coupled to the one end of the transistor N2, and the other end of the transistor N3 is coupled to the other end of the transistor N2.

A gate electrode of the transistor N4 is coupled to the other end of the transistor N1, and a control clock signal EM_CLK1 is applied to one end of the transistor N4.

The capacitor C11 is coupled between the gate electrode of the transistor N4 and the other end of the transistor N4.

One end of the transistor N5 is coupled to the other end of the transistor N4, a gate electrode of the transistor N5 is coupled to the other end of the transistor N2, and the other end of the transistor N5 is coupled to a high voltage power source VGH.

A gate electrode of the transistor N6 is coupled to the other end of the transistor N2, and the control clock signal EM_CLK1 is applied to one end of the transistor N6.

The capacitor C12 is coupled between the gate electrode of the transistor N6 and the other end of the transistor N6.

The control clock signal EM_CLK1 is applied to a gate electrode of the transistor N7, and one end of the transistor N7 is coupled to the other end of the transistor N6.

One end of the transistor N9 is coupled to the first scan line S11, the first driving clock signal CLK1 is applied to the other end of the transistor N9, and a gate electrode of the transistor N9 is coupled to the other end of the transistor N7.

The capacitor C13 is coupled between the gate electrode of the transistor N9 and the other end of the transistor N9.

One end of the transistor N8 is coupled to the gate electrode of the transistor N9, the other end of the transistor N8 is coupled to the other end of the transistor N9, and a gate electrode of the transistor N8 is coupled to the other end of the first transistor N1.

One end of the transistor N10 is coupled to the low voltage power source VGL, the other end of the transistor N10 is coupled to the first scan line S11, and a gate electrode of the transistor N10 is coupled to the other end of the transistor N1.

Hereinafter, a driving method of the stage ST11 will be described with reference to FIG. 3.

While the scan start pulse SSP1 is being applied at a low level to the stage ST11, the transistors N8 and N10 maintain an ON state regardless of a change in level of the control clock signals EM_CLK1 and EM_CLK2. At this time, the low voltage power source VGL is coupled to the first scan line S11 through the transistor N10, and hence a voltage having a low level is maintained in the first scan line S11. The transistor N9 is diode-coupled in the direction of the first driving clock signal CLK1 from the first scan line S11 due to the transistor N8 in the ON state, and hence the first driving clock signal CLK1 is not transferred to the first scan line S11.

Next, each of the scan start pulse SSP1 having a high level, the control clock signal EM_CLK2 having a low level, the control clock signal EM_CLK1 having a high level, and the first driving clock signal CLK1 having a low level is applied to the stage ST11 by the timing controller 15. At this time, the source start pulse SSP1 having the high level is transferred to the gate electrodes of the transistors N8 and N10, and hence the transistors N8 and N10 are in an OFF state. The transistor N9 is not in a diode state, but a voltage having a low level is applied to the gate electrode of the transistor N9 through the capacitor C13. Hence, the transistor N9 is in the OFF state. Thus, as the first scan line S11 is in a floating state, the voltage having the low level is maintained.

Next, each of the scan start pulse SSP1 having a low level, the control clock signal EM_CLK2 having a high level, the control clock signal EM_CLK1 having a low level, and the first driving clock signal CLK1 having a high level is supplied to the stage ST11 by the timing controller 15. At this time, a high-level voltage of the high voltage power source VGH is applied to the gate electrodes of the transistors N8 and N10 through the transistor N5, and hence the transistors N8 and N10 are still in the OFF state. The control clock signal EM_CLK1 having the low level is applied to the gate electrode of the transistor N9 through the transistors N7 and N6, and hence the transistor N9 is in the ON state. Thus, the first scan line S11 outputs the first driving clock signal CLK1 having the high level as a first scan signal through the transistor N9.

Next, each of the scan start pulse SSP1 having the low level, the control clock signal EM_CLK2 having the low level, the control clock signal EM_CLK1 having the high level, and the first driving clock signal CLK1 having the low level is supplied to the stage ST11 by the timing controller 15. At this time, the transistors N1 and N11 turned on by the control clock signal EM_CLK2 and the first driving clock signal CLK, which have the low level, apply the scan start pulse SSP1 having the low level to the gate electrodes of the transistors N8 and N10, and hence the transistors N8 and N10 are turned on. Thus, the first scan line S11 is coupled to the low voltage power source VGL through the transistor N10, and hence the first scan signal having a low level is output.

The first scan signal having a high level from the first scan line S11 is applied to one end of a transistor N11 of the second stage ST12. As if the scan start pulse is applied, the second stage ST12 is operated through the same or similar process of the first stage ST11 described above. Thus, the first scan signal having the high level can be sequentially output through the first scan line S12.

Figure 4:
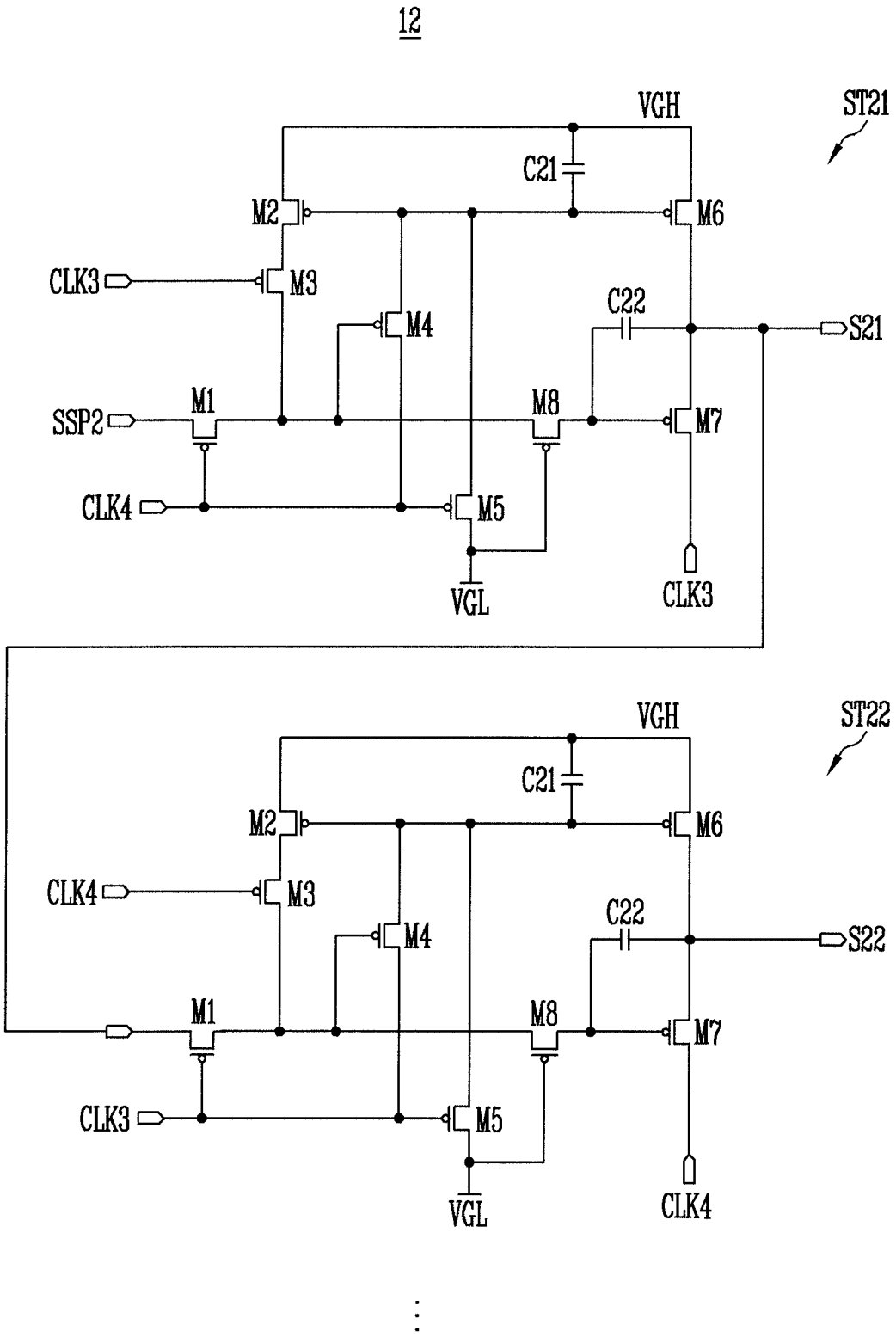
FIG. 4 is a diagram illustrating a second scan driver according to an embodiment of the present disclosure.
Figure 5:
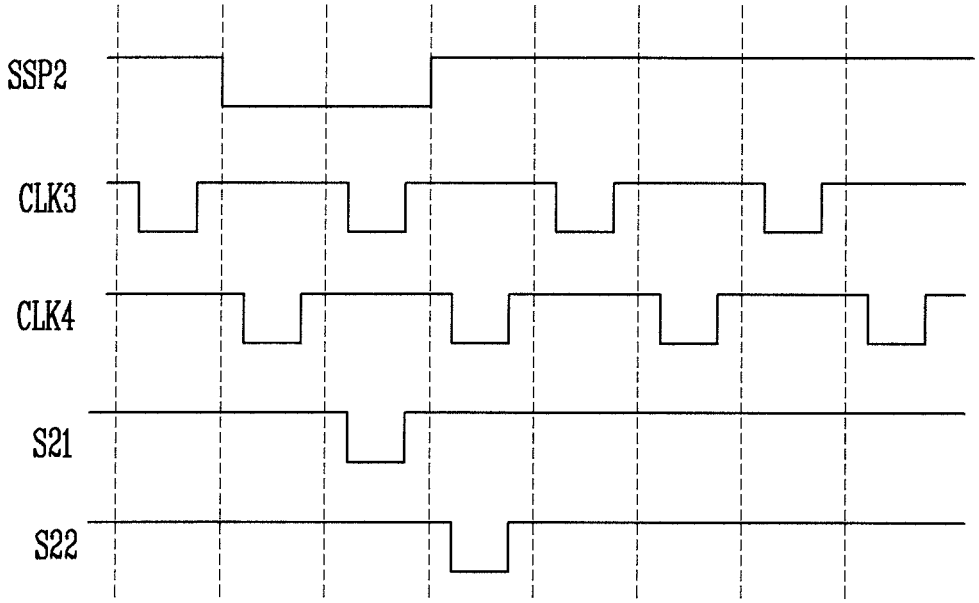
FIG. 5 is an exemplary timing diagram of the second scan driver of FIG. 4.

FIG. 4 is a diagram illustrating a second scan driver according to an embodiment of the present disclosure. FIG. 5 is an exemplary timing diagram of the second scan driver of FIG. 4. The distance between longitudinal dotted lines of FIG. 5 may correspond to one horizontal period.

Referring to FIG. 4, the second scan driver 12 according to the present embodiment includes a plurality of stages ST21, ST22, . . . . Because the stages have the same circuit configuration, the stages are described based on an initial stage ST21 in FIG. 4. The other stages ST22, . . . may be coupled in the form of shift registers from the initial stage ST21. For example, there is illustrated a form in which a second stage ST22 is coupled to the initial stage ST21.

The stage ST21 may include a plurality of transistors M1, M2, M3, M4, M5, M6, M7, and M8 and a plurality of capacitors C21 and C22. In FIG. 4, it is illustrated that the plurality of transistors M1, M2, M3, M4, M5, M6, M7, and M8 are P-type transistors, but a circuit for performing the same function, using N-type transistors, may be derived by those skilled in the art without undue experimentation.

A scan start pulse SSP2 is applied to one end of the transistor M1, and a second driving clock signal CLK4 is applied to a gate electrode of the transistor M1.

One end of the transistor M3 is coupled to the other end of the transistor M1, and a second driving clock signal CLK3 is applied to a gate electrode of the transistor M3.

One end of the transistor M2 is coupled to the other end of the transistor M3, and the other end of the transistor M2 is coupled to a high voltage power source VGH.

The second driving clock signal CLK4 is applied to one end of the transistor M4, a gate electrode of the transistor M4 is coupled to the other end of the transistor M1, and the other end of the transistor M4 is coupled to a gate electrode of the transistor M2.

One end of the transistor M5 is coupled to a low voltage power source VGL, the second driving clock signal CLK4 is applied to a gate electrode of the transistor M5, and the other end of the transistor M5 is coupled to the gate electrode of the transistor M2.

One end of the transistor M6 is coupled to the second scan line S21, and the other end of the transistor M6 is coupled to the high voltage power source VGH.

The capacitor C21 is coupled between a gate electrode of the transistor M6 and the other end of the transistor M6.

One end of the transistor M8 is coupled to the other end of the transistor M1, and a gate electrode of the transistor M8 is coupled to the low voltage power source VGL.

The second driving clock signal CLK3 is applied to one end of the transistor M7, a gate electrode of the transistor M7 is coupled to the other end of the transistor M8, and the other end of the transistor M7 is coupled to the second scan line S21.

The capacitor C22 is coupled between the gate electrode of the transistor M7 and the other end of the transistor M7.

Hereinafter, a driving method of the stage ST21 will be described with reference to FIG. 5.

While the timing controller 15 is maintaining the scan start pulse SSP2 having a high level, the high voltage power source VGH is coupled to the second scan line S21, as the transistor M6 maintains the ON state regardless of a change in level of the second driving clock signals CLK3 and CLK4. Thus, the second scan line S21 outputs a second scan signal having a high level.

When the timing controller 15 supplies the scan start pulse SSP2 having a low level, the second driving clock signal CLK3 having a high level, and the second driving clock signal CLK4 having a low level, the transistors M6 and M7 are simultaneously in the ON state, a voltage having a high level is applied to the second scan line S21 from the high voltage power source VGH and FROM the second driving clock signal CLK3. Thus, the second scan line S21 outputs the second scan signal having the high level.

Next, when the timing controller 15 supplies the scan start pulse SSP2 having the low level, the second driving clock signal CLK3 having a low level, and the second driving clock signal CLK4 having a high level, the gate electrode of the transistor M7 is in the floating state, and is boosted to a level lower than the low level by the falling of the second driving clock signal CLK3. Thus, the second driving clock signal CLK3 having the low level is applied to the second scan line S21 through the transistor M7 that maintains the ON state. Accordingly, the second scan line S21 outputs the second scan signal having a low level.

Next, when the timing controller 15 supplies the scan start pulse SSP2 having a high level, the second driving clock signal CLK3 having the high level, and the second driving clock signal CLK4 having the low level, the transistor M7 having the gate electrode to which the scan start pulse SSP2 having the high level is applied becomes in the OFF state, and the transistor M6 having the gate electrode to which the low voltage power source VGL is coupled becomes in the ON state. Thus, the high voltage power source VGH is coupled to the second scan line S21, and the second scan line S21 outputs the second scan signal having a high level.

A low-level second scan signal of the second scan line S21 is applied to one end of a transistor M1 of the second stage ST22. As if the scan start pulse is applied, the second stage ST22 is operated through the same or similar process of the first stage ST21 as described above. Thus, the second scan signal having the low level can be sequentially output through the second scan line S22.

Figure 6:
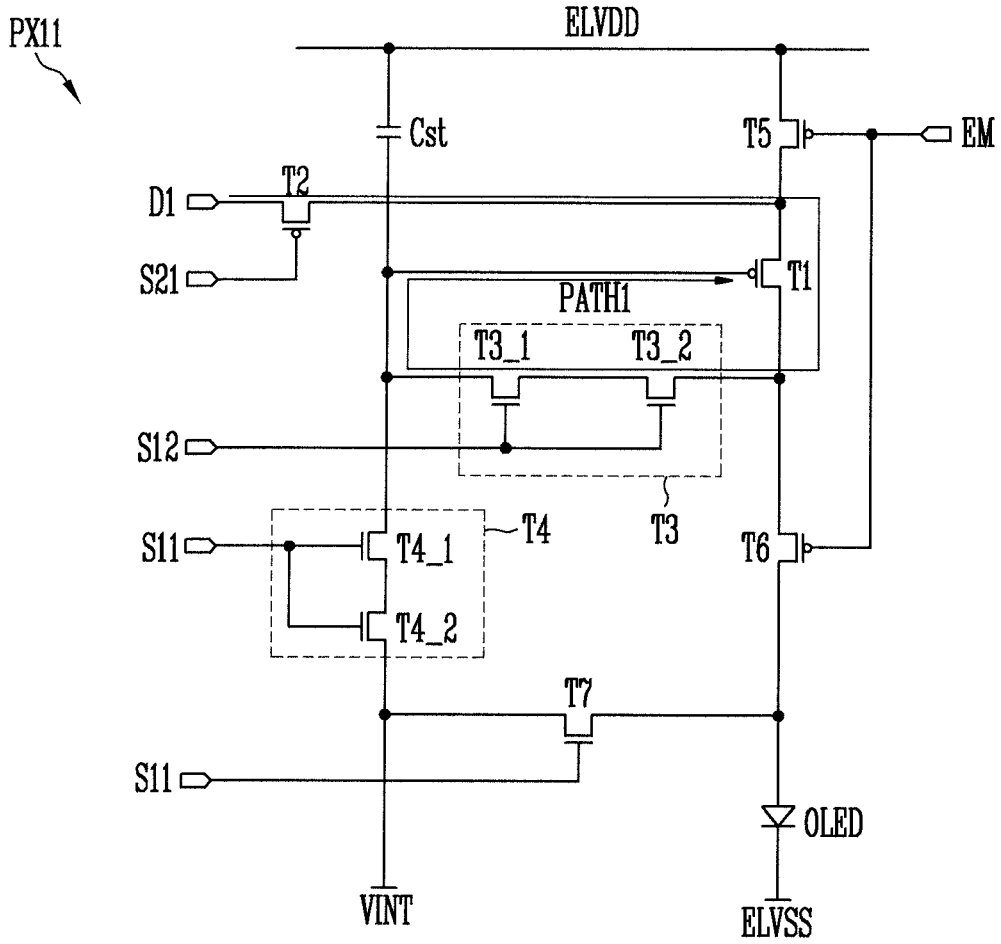
FIG. 6 is a diagram illustrating a pixel according to an embodiment of the present disclosure.
Figure 7:
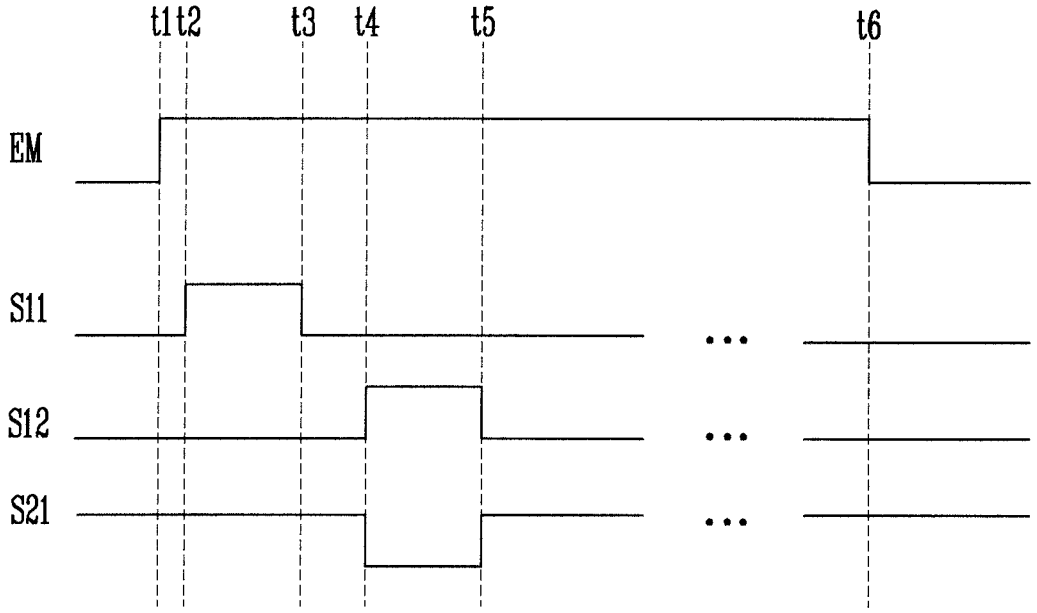
FIG. 7 is an exemplary timing diagram for driving the pixel of FIG. 6.

FIG. 6 is a diagram illustrating a pixel according to an embodiment of the present disclosure. FIG. 7 is an exemplary timing diagram for driving the pixel of FIG. 6.

Referring to FIG. 6, the pixel PX11 according to the present embodiment includes a plurality of transistors T1, T2, T3, T4, T5, T6, and T7, a storage capacitor Cst, and an organic light emitting diode OLED. For example, the transistors T1, T2, T5, and T6 are configured as P-type transistors, and the transistors T3, T4, and T7 are configured as N-type transistors. As the types of some transistors are changed, a pixel circuit for performing the same function may be configured by those skilled in the art.

One end of the transistor T2 is coupled to a data line D1, and a gate electrode of the transistor T2 is coupled to the second scan line S21.

A cathode of the organic light emitting diode OLED is coupled to a low voltage power source ELVSS, and an anode of the organic light emitting diode OLED is coupled to one end of the transistor T6.

An emission control signal EM is applied to a gate electrode of the transistor T6, and the other end of the transistor T6 is coupled to one end of the transistor T1.

The other end of the transistor T1 is coupled to the other end of the transistor T2. The transistor T1 allows the organic light emitting diode OLED to emit light with a target gray scale by changing or controlling a current that flows according to a difference between a gate voltage and a source voltage thereof. Hence, the transistor T1 is also referred to as a driving transistor.

The transistor T3 allows the one end of the transistor T1 and a gate electrode of the transistor T1 to be coupled to each other. In some embodiments, the transistor T3 may be configured with two or more sub-transistors T3_1 and 13_2. Accordingly, leakage current can be effectively reduced or prevented.

The storage capacitor Cst allows the gate electrode of the transistor T1 and a high voltage power source ELVDD to be coupled to each other. The storage capacitor Cst performs a function of storing a data voltage corresponding to a target gray scale, and continuously applying the data voltage to the gate electrode of the transistor T1.

One end of the transistor T4 is coupled to an initialization power source VINT, and the other end of the transistor T4 is coupled to the gate electrode of the transistor T1. In some embodiments, the transistor T4 may be configured with two or more sub-transistors T4_1 and T4_2. Accordingly, leakage current can be effectively reduced or prevented. The voltage of the initialization power source VINT may be set to be lower than the lowest data voltage.

One end of the transistor T7 is coupled to the initialization power source VINT, the other end of the transistor T7 is coupled to the anode of the organic light emitting diode OLED, and a gate electrode of the transistor T7 is coupled to the first scan line S11.

One end of the transistor T5 is coupled to the other end of the transistor T1, the emission control signal EM is applied to a gate electrode of the transistor T5, and the other end of the transistor T5 is coupled to the high voltage power source ELVDD.

Hereinafter, a driving method of the pixel circuit PX11 will be described with reference to FIG. 6. The method for generating the first scan signals of the first scan lines S11 and S12 and the second scan signal of the second scan line S21 has been described with reference to FIGS. 2 to 5.

First, in order to end the emission of a corresponding pixel, the emission control signal EM has a high level at a time t1, so that the transistors T5 and T6 are in the OFF state. Accordingly, the supply of current to the organic light emitting diode OLED is stopped, and the emission of the pixel circuit PX11 is ended.

Next, the first scan signal of the first scan line S11 has a high level at a time t2, so that the transistors T4 and T7 are turned on. Thus, an initialization step is performed, such that charges remaining at the gate electrode of the transistor T1, and charges remaining at the anode of the organic light emitting diode OLED, are escaped or discharged through the initialization power source VINT.

The first scan signal of the first scan line S11 has a low level at time t3, so that the initialization step is ended. At a time t4, the first scan signal of the first scan line S12 has a high level, and the second scan signal of the second scan line S21 has a low level. The transistor T3 is in the ON state according to the first scan signal of the first scan line S12 so that the transistor T1 is diode-coupled in the direction of the gate electrode thereof. In addition, the transistor T2 is in the ON state according to the second scan signal of the second scan line S21. At this time, a data voltage having a target gray scale may be applied to the data line D1 in advance. The data voltage is applied to the gate electrode of the transistor T1 through a first path PATH1, and is stored in the storage capacitor Cst. Accordingly, a compensation and data writing step is performed in which different critical voltages of the transistor T1 are compensated for every pixel circuit, and a target data voltage is written in the storage capacitor Cst.

At a time t5, the first scan signal of the first scan line S12 has a low level, and the second scan signal of the second scan line S21 has a high level, so that the compensation and data writing step is ended as the first path PATH1 is closed.

At a time t6, the emission control signal EM has a low level so that the transistors T5 and T6 are turned on. Accordingly, a current is supplied from the high voltage power source ELVDD to the organic light emitting diode OLED through the transistor T1. At this time, the supplied current is based on a voltage stored in the storage capacitor Cst between the times t4 and t5.

Figure 8:
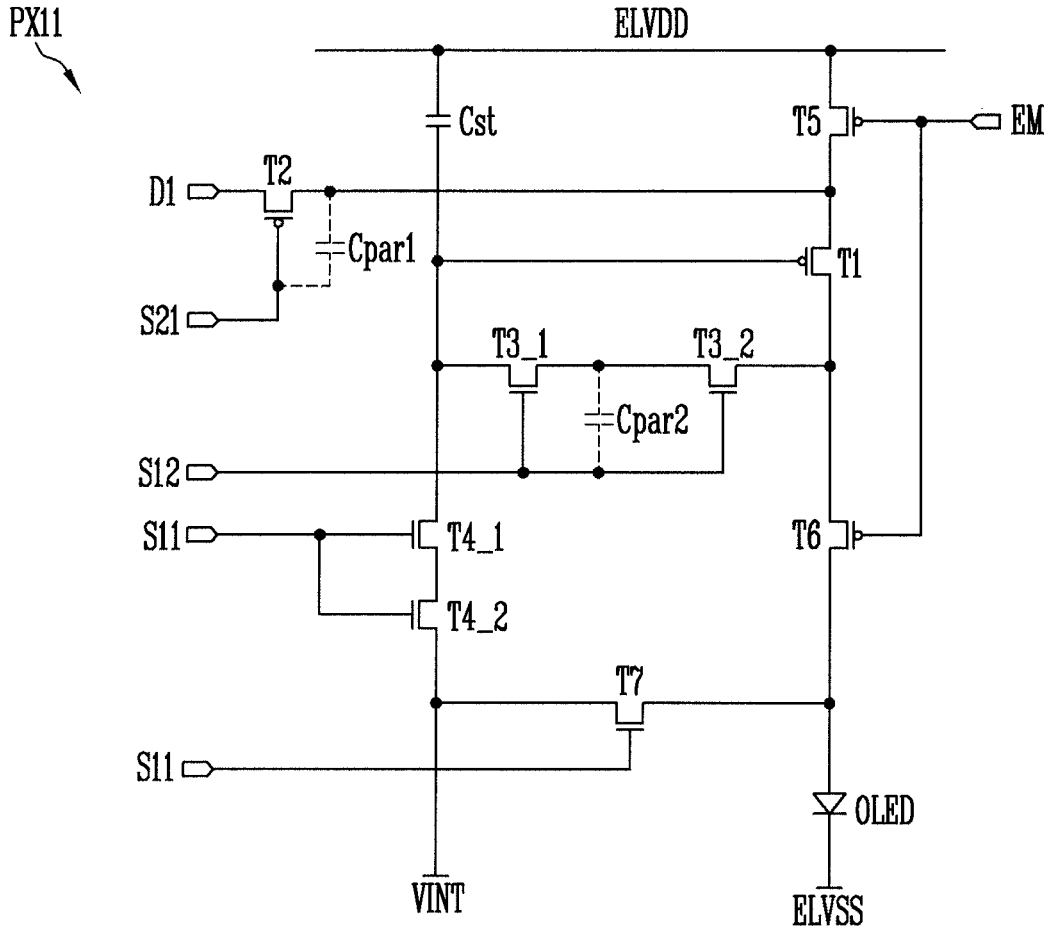
FIG. 8 is a diagram illustrating parasitic capacitors existing in the pixel of FIG. 6.
Figure 9:
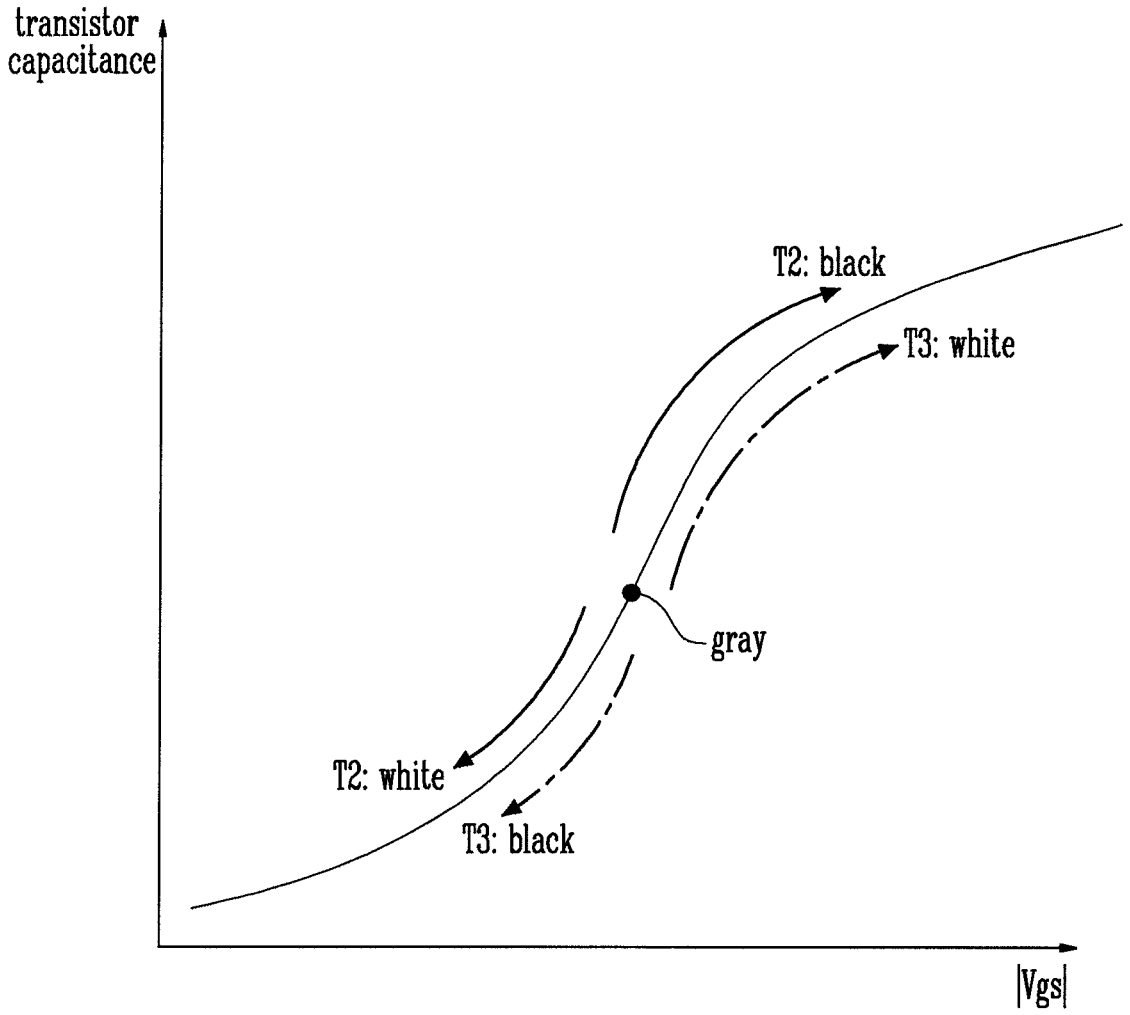
FIG. 9 is a diagram illustrating a change in magnitudes of the parasitic capacitors of FIG. 8.
Figure 10:
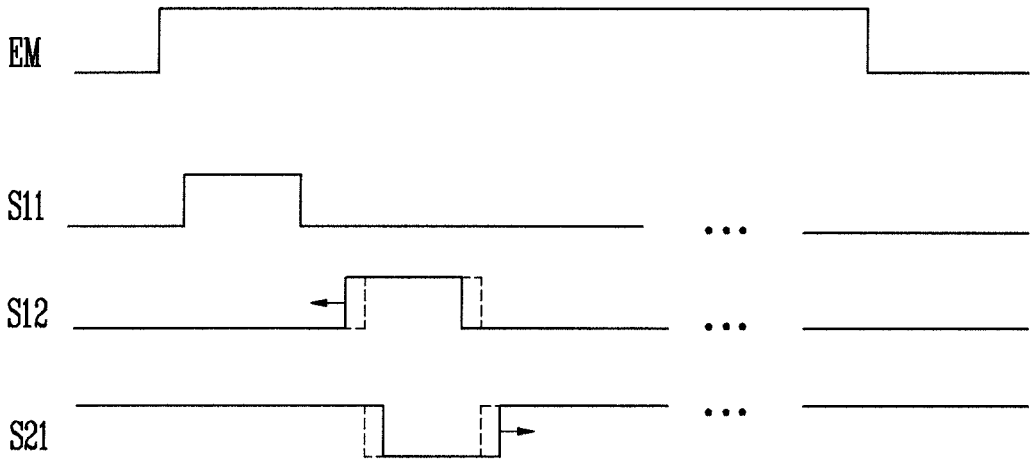
FIG. 10 is a diagram illustrating variations in phases of first and second scan signals due to the parasitic capacitors.

FIG. 8 is a diagram illustrating parasitic capacitors, or parasitic capacitance, existing in the pixel of FIG. 6. FIG. 9 is a diagram illustrating a change in magnitudes of the parasitic capacitors of FIG. 8. FIG. 10 is a diagram illustrating variations in phases of the first and second scan signals due to the parasitic capacitors.

A gate electrode and both ends of a transistor are arranged with a dielectric interposed therebetween, and hence, parasitic capacitors exist due to the structure of the transistor. In this embodiment, only a parasitic capacitor Cpar1 of the transistor T2 and a parasitic capacitor Cpar2 of the transistor T3 (T3_1 and T3_2), which may cause horizontal crosstalk, will be described. The parasitic capacitors Cpar1 and Cpar2 are electrically coupled to the second scan line S21 and the first scan line S12, respectively.

Referring to FIG. 9, the magnitude of the parasitic capacitor Cpar1 according to a difference between a gate voltage and a source voltage is indicated by a solid line arrow, and the magnitude of the parasitic capacitor T3 (T3_1 and T3_2) is indicated by a one-dotted chain line arrow.

The transistor T2 is a P-type transistor, and the magnitude of the parasitic capacitor Cpar1 increases as the data voltage becomes higher (e.g., as the data voltage becomes closer to black). The magnitude of the parasitic capacitor Cpar1 decreases as the data voltage becomes lower (e.g., as the data voltage becomes closer to white).

On the other hand, the transistor T3 (e.g., T3_1 and T3_2) is an N-type transistor, and the magnitude of the parasitic capacitor Cpar2 decreases as the data voltage becomes higher (e.g., as the data voltage becomes closer to black). The magnitude of the parasitic capacitor Cpar2 increases as the data voltage becomes lower (e.g., as the data voltage becomes closer to white).

That is, the transistors T2 and the transistor T3 (T3_1 and T3_2), of which transistor types are different from each other, have different directions in which the magnitudes of the parasitic capacitors increase/decrease. Therefore, a problem occurs as shown in FIG. 10.

In FIG. 10, it is assumed that a high data voltage corresponding to black is applied to the data line D1. At this time, the magnitude of the parasitic capacitor Cpar1 increases, and the magnitude of the parasitic capacitor Cpar2 decreases.

Referring to FIG. 10, it is illustrated that the transition of the second scan signal of the second scan line S21 becomes late as a change in voltage becomes late due to the increased magnitude of the parasitic capacitor Cpar1. In addition, it is illustrated that the transition of the first scan signal of the first scan line S12 becomes fast as a change in voltage becomes fast due to the decreased magnitude of the parasitic capacitor Cpar2.

Therefore, a high level section of the first scan signal of the first scan line S12 does not sufficiently overlap with a low level section of the second scan signal of the second scan line S21, and hence, the compensation and data writing period of a storage capacitor Cst of an adjacent pixel circuit is decreased. That is, a current is applied through the first path PATH1 for only an amount of time that is shorter than an ideal or suitable amount of time.

Therefore, a target voltage is not fully written in the storage capacitor Cst of the adjacent pixel circuit, which results in horizontal crosstalk in which all pixel circuits on a pixel row, to which a corresponding scan line is coupled, do not emit light with a target gray scale.

Figure 11:
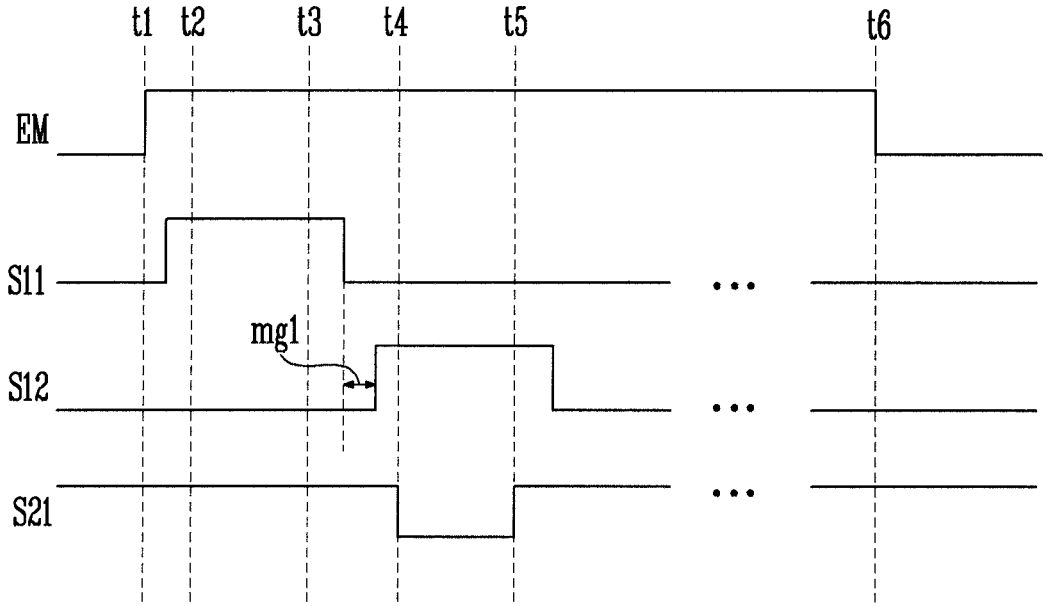
FIG. 11 is a diagram illustrating the first scan signal in a display device according to a first embodiment of the present disclosure.

FIG. 11 is a diagram illustrating the first scan signal in a display device according to a first embodiment of the present disclosure.

In order to solve the problem described in FIG. 10, in the first embodiment of the present disclosure, the width of the high level section of the first scan signal of the first scan line S12 is wider than that of the low level section of the second scan signal of the second scan line S21, and the low level section of the second scan signal of the second scan line S21 overlaps with the high level section of the first scan signal of the first scan line S12 (e.g., overlaps with a middle portion of the high level section of the first scan signal of the first scan line S12). To this end, the widths of the first driving clock signals CLK1 and CLK2 supplied from the timing controller 15 to the first scan driver 11 may be adjusted.

In the embodiment of FIG. 11, as compared with FIG. 7, the first embodiment is implemented such that the width of the high level section of the first scan signal of the first scan line S12 is increased. Contrastingly, in another embodiment, as compared with FIG. 7, the first embodiment may be implemented such that the width of the low level section of the second scan signal of the second scan line S21 is decreased. To this end, the widths of the second driving clock signals CLK3 and CLK4 supplied from the timing controller 15 to the second scan driver 12 may be suitably adjusted.

Figure 12:
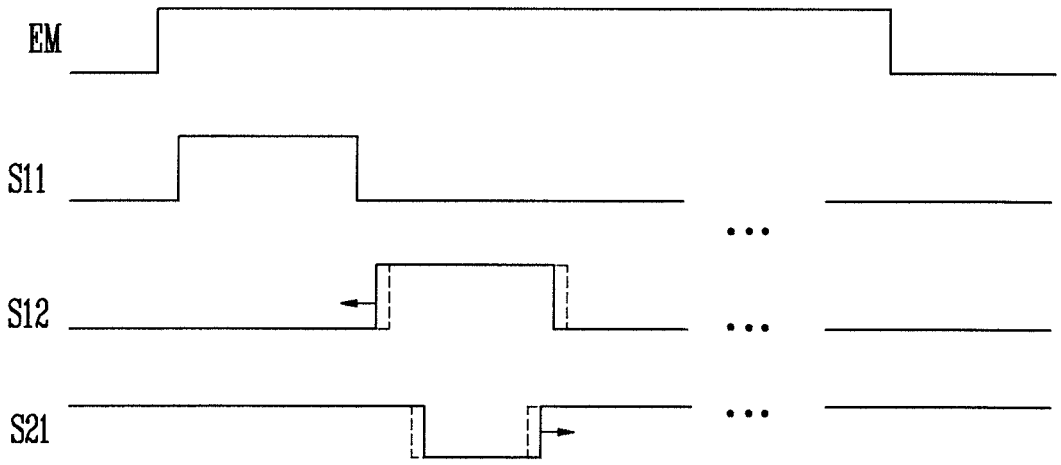
FIG. 12 is a diagram illustrating when the phases of the first and second signals of FIG. 11 are varied.

FIG. 12 is a diagram illustrating when the phases of the first and second signals of FIG. 11 are varied.

Referring to FIG. 12, when the display device is driven according to the first embodiment of FIG. 11, the low level section of the second scan signal of the second scan line S21 sufficiently overlaps with the high level section of the first scan signal of the first scan line S12 even when the phases of the first and second scan signals of the first and second scan lines S12 and S21 are changed due to the parasitic capacitors Cpar1 and Cpar2, respectively. Thus, the compensation and data writing period of the storage capacitor Cst of the adjacent pixel circuit can be suitably ensured.

Figure 13:
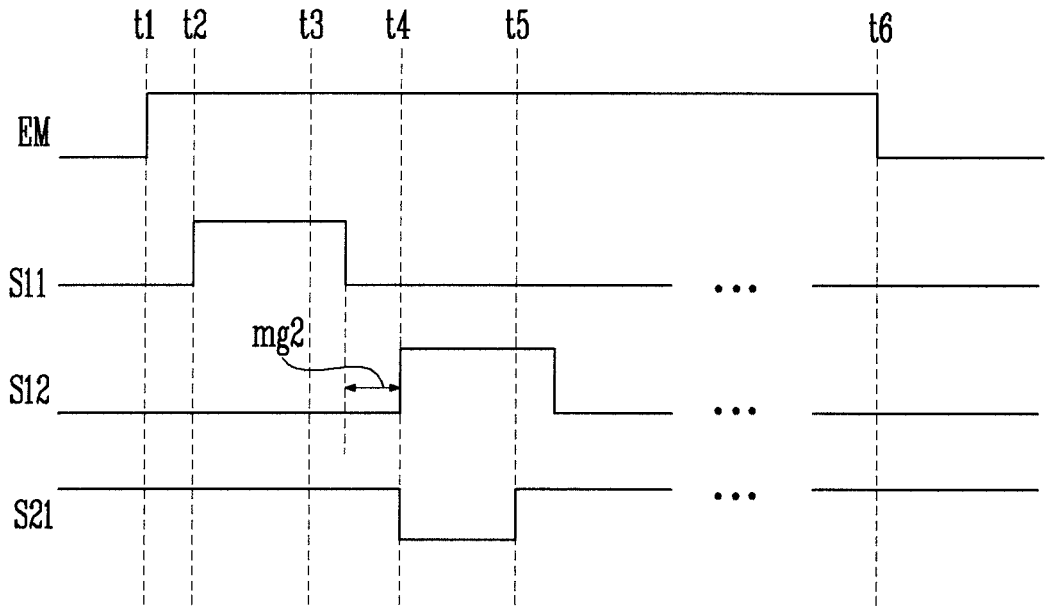
FIG. 13 is a diagram illustrating the first scan signal in a display device according to a second embodiment of the present disclosure.

FIG. 13 is a diagram illustrating the first scan signal in a display device according to a second embodiment of the present disclosure.

Referring to FIG. 13, according to the second embodiment of the present disclosure, the rising transition time of the first scan signal of the first scan line S12 may correspond to the falling transition time of the second scan signal of the second scan line S21, and the falling transition time of the first scan signal of the first scan line S12 may be after the rising transition time of the second scan signal of the second scan line S21. That is, as compared with FIG. 7, the first scan signal is generated such that the falling transition time of the first scan signal of the first scan line S12 is later.

In this case, a margin mg2 of the second embodiment may be ensured to be larger than a margin mg1 of the first embodiment (see FIG. 11). Thus, although the rising transition time of the first scan signal of the first scan line S12 becomes fast or early due to the parasitic capacitor, it is possible to reduce the probability that the first scan signal of the first scan line S12 will overlap with the first scan signal of the first scan line S11.

In addition, when referring to the directions in which the first and second scan signals of FIG. 10 are moved due to the parasitic capacitors, like the first embodiment, the low level section of the second scan signal of the second scan line S21 sufficiently overlaps with the high level section of the first scan signal of the first scan line S12, and thus the compensation and data writing period of the storage capacitor Cst of the adjacent pixel circuit can be ensured.

FIG. 3 will be again referred to describe an exemplary method for implementing the second embodiment.

Referring to FIG. 3 and the driving method thereof, the period of the first control clock signal EM_CLK2 determines an allowable range AP of the width of the high level section of the first driving clock signal CLK1. That is, the falling transition time of the first control clock signal EM_CLK2 may correspond to a suitable or maximum value of the allowable range AP.

According to a third embodiment of the present disclosure, the timing controller 15 may supply the first driving clock signals CLK1 and CLK2 having the width of a high level section that is independently determined for each frame. Specifically, the timing controller 15 may determine the width of the high level section of the first driving clock signals CLK1 and CLK2, corresponding to the maximum data voltage applied to the data lines D1, D2, . . . , Dm during one frame. At this time, the timing controller 15 may increase the width of the high level section of the first driving clock signals CLK1 and CLK2 as the maximum data voltage becomes higher.

According to the third embodiment of the present disclosure, when the maximum data voltage of a specific frame is high, the width of the high level section of the first scan signal is considerably increased according to the first and second embodiments of the present disclosure. When the maximum data voltage of another specific frame is low, the width of the high level section of the first scan signal is slightly increased or is not increased at all. Thus, margins of the first scan signal with previous and subsequent scan signals can be further ensured.

In the display device and the driving method thereof according to the present disclosure, it is possible to ensure a sufficient compensation time, thereby ensuring robustness against horizontal crosstalk.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present disclosure as set forth in the following claims, with equivalents thereof to be included.

What is claimed is:

1. A display device comprising:

a pixel circuit including a driving transistor, an N-type transistor on a first path coupled from a data line to a gate electrode of the driving transistor, and a P-type transistor on the first path;

a first scan driver configured to supply a first scan signal to the N-type transistor; and a second scan driver configured to supply a second scan signal to the P-type transistor, wherein a width of a high level section of the first scan signal is wider than that of a low level section of the second scan signal, and the low level section of the second scan signal overlaps with the high level section of the first scan signal, and wherein the first scan signal is for causing the driving transistor to be diode-coupled.

2. The display device of claim 1, wherein a rising transition time of the first scan signal corresponds to a falling transition time of the second scan signal.

3. The display device of claim 2, wherein a falling transition time of the first scan signal is after a rising transition time of the second scan signal.

4. The display device of claim 1, further comprising a timing controller configured to supply a first driving clock signal and a second driving clock signal to the first scan driver and the second scan driver, respectively, wherein the first scan driver supplies a portion of the first driving clock signal as the first scan signal, and wherein the second scan driver supplies a portion of the second driving clock signal as the second scan signal.

5. The display device of claim 4, wherein the timing controller further supplies a first control clock signal to the first scan driver, and wherein a period of the first control clock signal determines an allowable range of the width of a high level section of the portion of the first driving clock signal.

6. The display device of claim 5, wherein a falling transition time of the first control clock signal is a maximum value of the allowable range.

7. The display device of claim 4, wherein the timing controller supplies the first driving clock signal having the width of a high level section, which is independently determined for each frame.

8. The display device of claim 7, wherein the timing controller determines the width of a high level section of the first driving clock signal according to a maximum data voltage applied to the data line during one frame.

9. The display device of claim 8, wherein the timing controller increases the width of the high level section of the first driving clock signal as the maximum data voltage become higher.

10. A display device comprising:

a pixel circuit including a driving transistor, an N-type transistor on a first path coupled from a data line to a gate electrode of the driving transistor, and a P-type transistor on the first path;

a first scan driver configured to supply a first scan signal to the N-type transistor; and a second scan driver configured to supply a second scan signal to the P-type transistor, wherein a width of a high level section of the first scan signal is wider than that of a low level section of the second scan signal, and the low level section of the second scan signal overlaps with the high level section of the first scan signal, wherein the P-type transistor is coupled between the data line and one end of the driving transistor, and wherein the N-type transistor is coupled between the other end of the driving transistor and the gate electrode of the driving transistor.

11. A method for driving a display device including a driving transistor, an N-type transistor on a first path coupled from a data line to a gate electrode of the driving transistor, and a P-type transistor on the first path, the method comprising:

applying a specific voltage to the data line;

applying a first scan signal having a high level to a gate electrode of the N-type transistor to cause the driving transistor to be diode-coupled; and applying a second scan signal having a low level to a gate electrode of the P-type transistor, wherein a width of a high level section of the first scan signal is wider than that of a low level section of the second scan signal, and wherein the low level section of the second scan signal overlaps with the high level section of the first scan signal.

12. The method of claim 11, wherein a rising transition time of the first scan signal corresponds to a falling transition time of the second scan signal.

13. The method of claim 12, wherein a falling transition time of the first scan signal is after a rising transition time of the second scan signal.

14. The method of claim 11, further comprising independently determining the width of the high level section of the first scan signal for each frame.

15. The method of claim 14, wherein the width of the high level section of the first scan signal is determined corresponding to a maximum data voltage applied to the data line during one frame.

16. The method of claim 15, wherein the width of the high level section of the first scan signal is increased as the maximum data voltage becomes higher.

* * * * *